US005293980A

United States Patent [19]

Parker

[11] Patent Number: 5,293,980

[45] Date of Patent: Mar. 15, 1994

[54] COIN ANALYZER SENSOR CONFIGURATION AND SYSTEM

[76] Inventor: Donald O. Parker, 987 3 Mile Rd., Grand Rapids, Mich. 49505

[21] Appl. No.: 847,773

[22] Filed: Mar. 5, 1992

[51] Int. Cl.[5] ..... G07D 5/08

[52] U.S. Cl. ..... 194/317; 324/236

[58] Field of Search ..... 194/317, 318, 319; 324/233, 236; 336/178; 209/567, 570

[56] References Cited

U.S. PATENT DOCUMENTS

| | | | |
|---|---|---|---|
| Re. 28,827 | 5/1976 | Fougere . | |
| Re. 29,090 | 12/1976 | Fougere . | |
| 2,317,351 | 4/1943 | Andalikiewicz et al. . | |
| 2,390,147 | 12/1945 | Hatton | 194/317 |
| 2,589,214 | 3/1952 | Andrews . | |
| 3,059,749 | 10/1962 | Zinke . | |
| 3,147,839 | 8/1964 | White, Jr. . | |
| 3,152,677 | 10/1964 | Phillips . | |
| 3,169,626 | 2/1965 | Miyagawa et al. . | |
| 3,317,016 | 5/1967 | Turillon . | |
| 3,481,443 | 12/1969 | Meloni . | |
| 3,506,103 | 4/1970 | Kuckens et al. . | |
| 3,539,005 | 11/1970 | Nekvinda | 209/570 |
| 3,576,244 | 4/1971 | Ptacek . | |
| 3,596,744 | 8/1971 | Chesnokoy et al. . | |
| 3,599,771 | 8/1971 | Hinterstocker . | |
| 3,682,286 | 8/1972 | Prumm . | |
| 3,739,895 | 6/1973 | Fougere . | |
| 3,741,363 | 6/1973 | Hinterstocker . | |
| 3,749,220 | 7/1973 | Tabiichi et al. . | |
| 3,796,295 | 3/1974 | Montolivo et al. . | |
| 3,797,307 | 3/1974 | Johnston | 73/163 |
| 3,837,454 | 9/1974 | Joeck . | |
| 3,868,663 | 3/1975 | Tschierse | 324/41 |
| 3,870,137 | 3/1975 | Fougere . | |
| 3,901,367 | 8/1975 | Miyazawa . | |
| 3,901,368 | 8/1975 | Klinger . | |
| 3,930,512 | 1/1976 | Woodland . | |
| 3,939,953 | 2/1976 | Miyazawa . | |
| 3,952,851 | 4/1976 | Fougere et al. . | |
| 3,962,627 | 6/1976 | Ptacek et al. | 324/34 R |
| 3,977,508 | 8/1976 | Baumberger . | |

(List continued on next page.)

FOREIGN PATENT DOCUMENTS

| | | | |
|---|---|---|---|
| 1930345 | 12/1970 | Fed. Rep. of Germany | 194/317 |
| 2916123 | 10/1980 | Fed. Rep. of Germany . | |
| 645201 | 9/1984 | Switzerland . | |
| 656240 | 6/1986 | Switzerland . | |
| 633044 | 11/1978 | U.S.S.R. . | |
| 1582847 | 1/1981 | United Kingdom . | |
| 2069211 | 8/1981 | United Kingdom . | |
| 1604536 | 12/1981 | United Kingdom . | |
| 2200778 | 8/1988 | United Kingdom . | |
| 2215505 | 9/1989 | United Kingdom . | |

*Primary Examiner*—F. J. Bartuska

*Attorney, Agent, or Firm*—Price, Heneveld, Cooper, DeWitt & Litton

[57] ABSTRACT

A coin analyzer system includes a coin detecting sensor having a body defined by a magnetic core with spaced apart sides to define there-between an air gap that is large enough to position any size coin which may be deposited. A coil that is magnetically coupled to the core generates a uniform magnetic flux through the air gap from one side to the other so that the positioning of the coin in the air gap is not critical. A return path is provided in the core for returning the magnetic flux to the one side from the other side and thereby completing the magnetic circuit. The arms surrounding the coin sensing region define facing surfaces which converge outwardly from the bite portion in order to produce a uniform magnetic circuit reluctance for all portions of the facing surfaces. The core may be divided into two core portions separated by a secondary air gap in the return path with a pair of coils provided, one magnetically coupled with each of the core portions. One coil may serve as a transmitting coil and the other as a receiving coil. Various detection circuits are disclosed for connection with the sensor coils in order to determine the denomination of the test coin.

33 Claims, 5 Drawing Sheets

U.S. PATENT DOCUMENTS

| | | | |
|---|---|---|---|
| 3,980,168 | 9/1976 | Knight et al. . | |
| 4,082,099 | 4/1978 | Iwersen . | |
| 4,084,677 | 4/1978 | Searle et al. . | |
| 4,086,527 | 4/1978 | Cadot | 324/233 |
| 4,089,400 | 5/1978 | Gregory, Jr. . | |
| 4,096,933 | 6/1978 | Massa . | |
| 4,108,296 | 8/1978 | Hayashi et al. . | |
| 4,109,774 | 8/1978 | Hayashi . | |
| 4,226,323 | 10/1980 | Dautremont | 194/317 |
| 4,254,857 | 3/1981 | Levasseur et al. . | |
| 4,298,116 | 11/1981 | Niemeyer . | |
| 4,432,447 | 2/1984 | Tanaka . | |
| 4,437,558 | 3/1984 | Nicholson et al. . | |
| 4,441,602 | 4/1984 | Ostroski et al. . | |
| 4,465,173 | 8/1984 | Domen et al. . | |
| 4,469,213 | 9/1984 | Nicholson et al. . | |
| 4,574,936 | 3/1986 | Klinger | 194/318 |
| 4,625,851 | 12/1986 | Johnson et al. | 194/200 |
| 4,848,556 | 7/1989 | Shah et al. | 194/212 |
| 4,884,672 | 12/1989 | Parker | 194/318 |
| 4,895,238 | 1/1990 | Speas | 194/319 |
| 4,905,814 | 3/1990 | Parket et al. | 194/318 |
| 4,989,715 | 2/1991 | Grunig | 194/317 |
| 5,062,518 | 11/1991 | Chitty et al. | 194/317 |
| 5,067,604 | 11/1991 | Metcalf | 194/318 X |

COIN ANALYZER SENSOR CONFIGURATION AND SYSTEM

BACKGROUND OF THE INVENTION

This invention relates generally to a Coin Analyzer System for determining whether a coin is of a particular denomination and more particularly to a sensor configuration and detection circuitry for such a coin analyzer system. The invention is particularly adapted to determining whether a coin is one of a plurality of particular denominations.

U.S. Pat. No. 4,905,814 issued to the present inventor and Robert Rollins for a COIL CONFIGURATION FOR ELECTRONIC COIN TESTER AND METHOD OF MAKING, addressed the problems associated with known coils used to generate the magnetic fields in prior art coin acceptance devices. The known coil configurations generate generally doughnut shaped flux patterns. The coins' attenuation characteristics on the field as it passes through the field varies according to the coin's longitudinal and lateral position in relationship to the coil. As a result, coin paths had to be devised which caused the coin to be precisely positioned as it passed the coil. This usually resulted in significant slowing of the rate of travel of the coin and limited the range of coin sizes that could be successfully accepted with one coil.

The solution proposed in the '814 patent was to generate a magnetic flux normal to the face of a coin throughout the coin's diameter, regardless of the coins longitudinal position within the slot, by generating a magnetic flux pattern that is constant throughout the slot's longitudinal axis. This is accomplished in the '814 patent by providing coils wound in a loop on opposite sides of the coin slot generally parallel the longitudinal walls of the slot. The coils are wound in a manner that leaves a central gap and, thereby, purportedly generates magnetic flux lines that are normal to all points of the longitudinal walls.

The coil configuration of the '814 patent, however, does not operate practically in a commercial environment. The opposing coil loops are not capable of generating sufficient flux density to provide adequate detection-signal strength. Furthermore, the purportedly uniform field normal to the longitudinal walls is easily distorted by surrounding metal surfaces within the coin acceptor assembly, thus negating the intended beneficial effects of the sensor configuration. Attempts at correcting the surrounding-metal susceptibility, such as copper shielding, only tended to produce greater field distortions.

Another problem with prior art coin acceptance devices is the ability to develop adequate detection signal levels in order to provide greater discrimination between various coin denominations and between real and counterfeit coins. Various attempts have been made to improve the levels of the detection signals For example, in U.S. Pat. No. 4,469,213 issued to Raymond Nicholson and the present inventor for a COIN DETECTOR SYSTEM, a spiked signal source is provided, composed of a square wave voltage source and means for differentiating the square wave to produce a spiked signal containing a plurality of frequencies, ranging from the oscillator frequency of 17 kilohertz and multiples, or harmonics, thereof. While the intent of the '213 patent was to supply multiple frequencies in order to provide greater discrimination among various types of coins, the performance was marginal at best. The frequency spectrum was only sparsely populated and resulted in a resonant pulse being produced by the interaction between the primary oscillator frequency, or a low order harmonic thereof, and the reactance of the testing coils. This resonant pulse dominated the other frequencies in the spectrum and, thereby, eliminated most of the beneficial effect of the mixture of frequencies.

Other approaches to improving detection signal levels included placing the sensing coil in an oscillator circuit and measuring variation in phase angle and amplitude of oscillation output caused by the attenuation of the magnetic field as a test coin passes the sensing coil. Such an approach is suggested in U.S. Pat. No. 4,574,936, in which it is suggested that, by measuring multiple parameters, the ability to discriminate is improved. However, the difficulty experienced by inadequate detection signal levels is only marginally improved by monitoring multiple such signals. Other problems experienced by prior art detection circuits include high susceptibility to temperature variations and to changes in the component values with aging, requiring large acceptance windows to avoid repeated rejection of authentic coins.

SUMMARY OF THE INVENTION

The present invention is intended to provide a coin analyzer system having a unique sensor unit configuration and detection circuit arrangements which are capable of providing exceptional discrimination between various coin denominations as well as between authentic and counterfeit coins.

A coin detecting sensor according to the invention includes a body having spaced apart sides to define there-between an air gap in which a coin may be positioned. Means are provided for generating a magnetic flux through the air gap, from one side to the other side. A return path is provided in the body for returning the magnetic flux to the one side from the other side and thereby completing the magnetic circuit. Because a return path is provided for the magnetic current, the return magnetic current is confined to the body. The virtual elimination of stray magnetic flux, significantly reduces susceptibility to surrounding metal. Furthermore, exceptionally high flux densities may be provided in the air gap. Such high flux densities are promoted by making the body from a high permeability ferro-magnetic material.

In a more particular form, a sensor according to the invention includes a generally C-shaped core of ferromagnetic material including a bight portion and a pair of spaced apart arms, extending in a same direction from the bight portion, in order to define a coin sensing region between the arms. One or more coils are magnetically coupled with the core in order to generate a magnetic flux in the core and across the air gap when at least one coil is excited with electrical energy. In one form, the core may be divided into two core portions separated by an air gap in the return path, with a pair of coils provided, one magnetically coupled with each of the core portions. One coil may serve as a transmitting coil and the other as a receiving coil. In another form, the core may have a third core portion positioned between two such core portions to define a first sensing region for positioning a sample coin and a second sensing region for positioning a coin to be tested. Air gaps are provided in the flux return path between the central core portion and each of the other core portions. In a preferred embodiment, the arms surrounding the coin sensing region define facing surfaces having a multiplicity of surface portions which are separated by distances that are predetermined to provide a uniform magnetic circuit reluctance for all portions of the facing surfaces. The result is a convergence of the facing surfaces outwardly from the bight portion.

A detection circuit according to one aspect of the invention includes an oscillator circuit including an induction device, which forms a portion of a coin sensor unit, with the oscillator circuit adapted to oscillating at a quiescent condition with no coin in the magnetic field and thereby generating an output signal having a nominal frequency and nominal amplitude. A feedback circuit is provided that is responsive to the output signal and is adapted to producing a feedback signal that is supplied to the oscillator circuit to return the output signal to a quiescent condition in response to a test coin causing the output signal to deviate from the quiescent condition. A detection circuit is provided that is responsive to the feedback signal in order to identify whether a test coin is of a particular type of coin. The feedback signal displays a wide range of signal variation and, thereby, provides an exceptional degree of discrimination. By combining a variation in frequency as well as amplitude of the oscillator in response to a test coin, various characteristics of the test coin, such as electrical conductivity and field attenuation capability may be measured.

Other aspects of the invention are embodied in a coin detection system including a sample coin sensor unit that is adapted to generating and sensing a first magnetic field including means for positioning a sample coin in the first magnetic field. A test coin sensor unit is also provided that is adapted to generating and sensing a second magnetic field including means for positioning a test coin in the second magnetic field. A comparison circuit is provided that is responsive to the sample coin sensor unit and the test coin sensor unit and adapted to comparing the intensity of the first and second magnetic fields when a sample coin is in the first magnetic field and a test coin is in the second magnetic field. Such circuit typically has at least one natural resonance frequency. Accordingly, to an aspect of the invention, an excitation source is provided that is adapted to electrically exciting the sample coin sensor unit and test coin sensor unit. The source includes a square wave generator that generates a square wave having a fundamental frequency and a plurality of low-order and high-order harmonic frequencies. It has been discovered that superior detection signals are generated by such circuit if the natural resonance frequency of the circuit does not coincide with either the fundamental frequency or a low-harmonic frequency of the source. It has also been discovered that, by providing a non-differentiated square wave, a broad and full spectrum of frequencies are available for improving the comparison of the test coin with the sample coin. Because any resonant frequencies are above the primary frequency and the low number harmonic frequencies of the square wave generator, the creation of large resonant pulses, which tend to mask the effect of other frequencies in the square wave signal, is avoided.

According to yet another aspect of the invention, a detection circuit is provided that is responsive to the output of the comparison circuit. The detection circuit includes a differential amplifier having an output, a first input connected with the output of the comparison circuit and a second input connected with a reference voltage. A feedback means is also provided for latching the detection circuit output in one of two output states irrespective of the input conditions. This unique structure combines two functions that were separately performed in prior art systems.

These and other objects, advantages and features of this invention will become apparent upon review of the following specification in conjunction with the drawings.

DESCRIPTION OF THE PREFERRED EMBODIMENT

Figure 1:
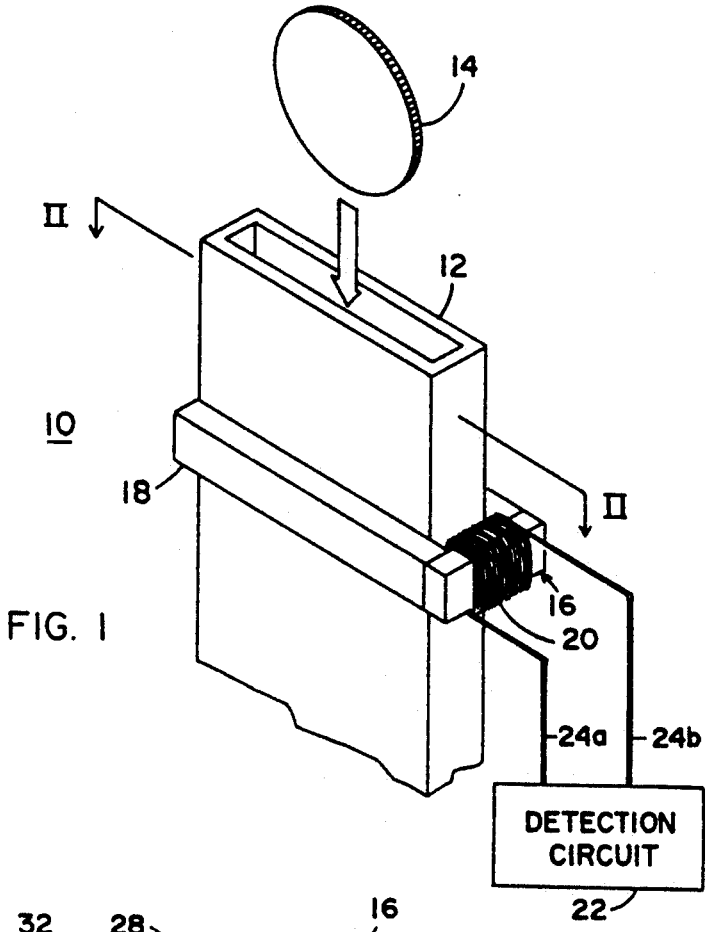
FIG. 1 is a perspective view of a coin analyzer system according to the invention.

Referring now specifically to the drawings, and the illustrative embodiments depicted therein, a coin analyzer system, generally illustrated at 10, includes a coin path 12 in which a test coin 14 is deposited by a user in order to operate a use device, such as a commercial washing machine, vending machine, car wash, or the like (not shown).

Juxtaposed with coin path 12 is a sensor 16 having a body 18 and electrical excitation means 20, which is magnetically coupled with body 18 and electrically connected with a detection circuit 22 by electrical leads 24A, 24B.

Figure 2:
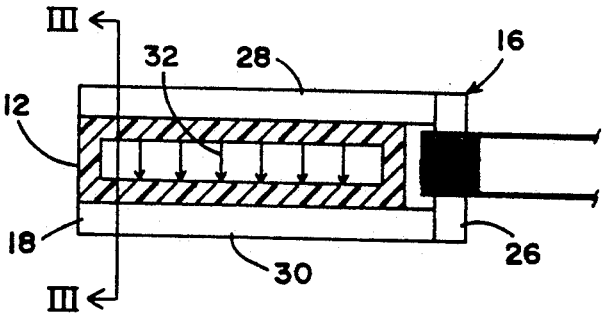
FIG. 2 is a sectional view taken along the lines II—II in FIG. 1.
Figure 3:
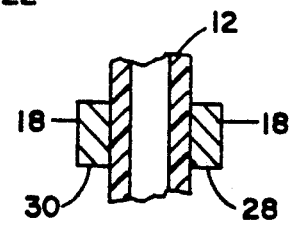
FIG. 3 is a sectional view taken along the lines III—III in FIG. 2.
Figure 4:
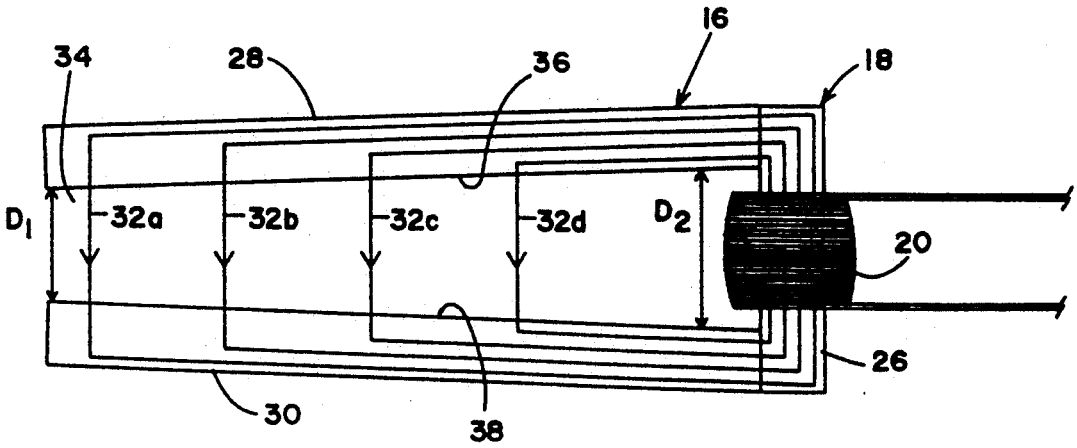
FIG. 4 is an enlarged plan view of a sensor according to the invention with particular features exaggerated for illustration purposes.

Body 18, which is made from a ferro-magnetic material, is generally U-shaped, or C-shaped, including a base or bight portion 26 and a pair of arms 28, 30 which extend in the same direction outwardly from bight portion 26 in a manner that straddles coin path 12 (FIGS. 2–4). Electrical excitation means 20 is magnetically coupled with body 18 in a manner that produces a uniform magnetic field across the short dimension of coin path 12, which is normal to arms 28 and 30. In the illustrated embodiment, electrical excitation means 20 is an induction device composed of an electrical coil wound around bight portion 26. Detection circuit 22 excites electrical coil 16 to produce a magnetic field across coin path 12. As a test coin traverses path 12, eddy currents are established in the coin as a function of the resistance, the size and the composition of the coin. The eddy currents, in turn, alter the field, which is detected by detection circuit 22. It should be understood that, although sensor 16 is illustrated in FIGS. 1-4 in association with a test coin, the same structure may be used as a sample coin sensing device in embodiments of the invention that function on the basis of the comparison of a test coin with one or more sample coins. Such systems are referred to as comparison systems.

Because the magnetic flux defining field 32 is uniform and normal to arms 28, 30, the effect of test coin 14 on the intensity of field 32 will be substantially identical irrespective of the position of the test coin in coin path 12, with respect to the axis of the coin both longitudinally of and perpendicular to the coin's diameter.

The manner in which sensor 16 achieves such uniform field is illustrated with reference to FIG. 3, which is exaggerated to illustrate the principal. Referring to FIG. 4, the flux lines illustrated as 32A-32D making up field 32 are formed in a circle, or circuit, extending from arm 28 to arm 30, across an air gap 34, defined between arms 28, 30 and returning to arm 28 through bight portion 26. Bight portion 26 and arms 28, 30 define a return path for the magnetic flux to return to the originating side of air gap 34 entirely within the confines of body 18. In this manner, the magnetic flux defining field 32 is confined to air gap 34 and body 18. In order to ensure the uniformity of the strength of flux lines defining the field 32, a surface 36 of arm 28 facing a surface 38 of arm 30 are spaced apart in a manner to provide uniform circuit reluctance for all flux lines crossing air gap 34. The length of the magnetic path that flux lines 32A, which are distal of bight portion 26, must travel is greater than than that of flux line 32D, which is closer to bight portion 26. Therefore, the distance D1 separating the surfaces 36, 38 at the point of traversal by flux line 32A is shorter than the distance D2 separating surfaces 36, 38 at the point that flux line 32D traverse air gap 34. As seen in FIG. 4, this has the effect of causing arms 28, 30 to converge away from bight portion 26. The degree of convergence is a function of the permeability of the ferro-magnetic material making up body 18 and the dimensions of air gap 34 and could be readily calculated by one of ordinary skill in the art. Because of the high permeability of the ferro-magnetic material defining body 18, the convergence of arms 28, 30 is barely visually perceivable and has the overall appearance as illustrated in FIGS. 1 and 2.

In the embodiment illustrated in FIGS. 1-3, sensor 16 is made from high permeability ferro-magnetic material. A preferred minimum permeability is 2,000. Such material is commercially available in ferrite bars made from iron powder in a glass binder molded to the desired shape. Such bars are marketed by Dexter Magnetics. Arms 28, 38 and bight portion 26 are made from a uniform cross section of 0.180 inches by 0.375 inches, with the greatest thickness of the bar being in the plane of the core perpendicular the coin path, as best seen in FIG. 3. Arms 28, 30 are 1.1875 inches in length and bight portion 26 is 0.75 inches in length. Arms 28, 30 converge away from bight portion 26 to a minimum separation of 0.25 inches. A minimum clearance of 0.0625 inches is provided between the interior of the coin path 12 and any portion of the sensor unit. This may be accomplished by making the coin path from 0.0625 inch thick plastic sheet. Excitation means 20 is an inductive coil having approximately 127 turns of 32 or 34 AWG magnet wire wound around bight portion 26.

Figure 5:
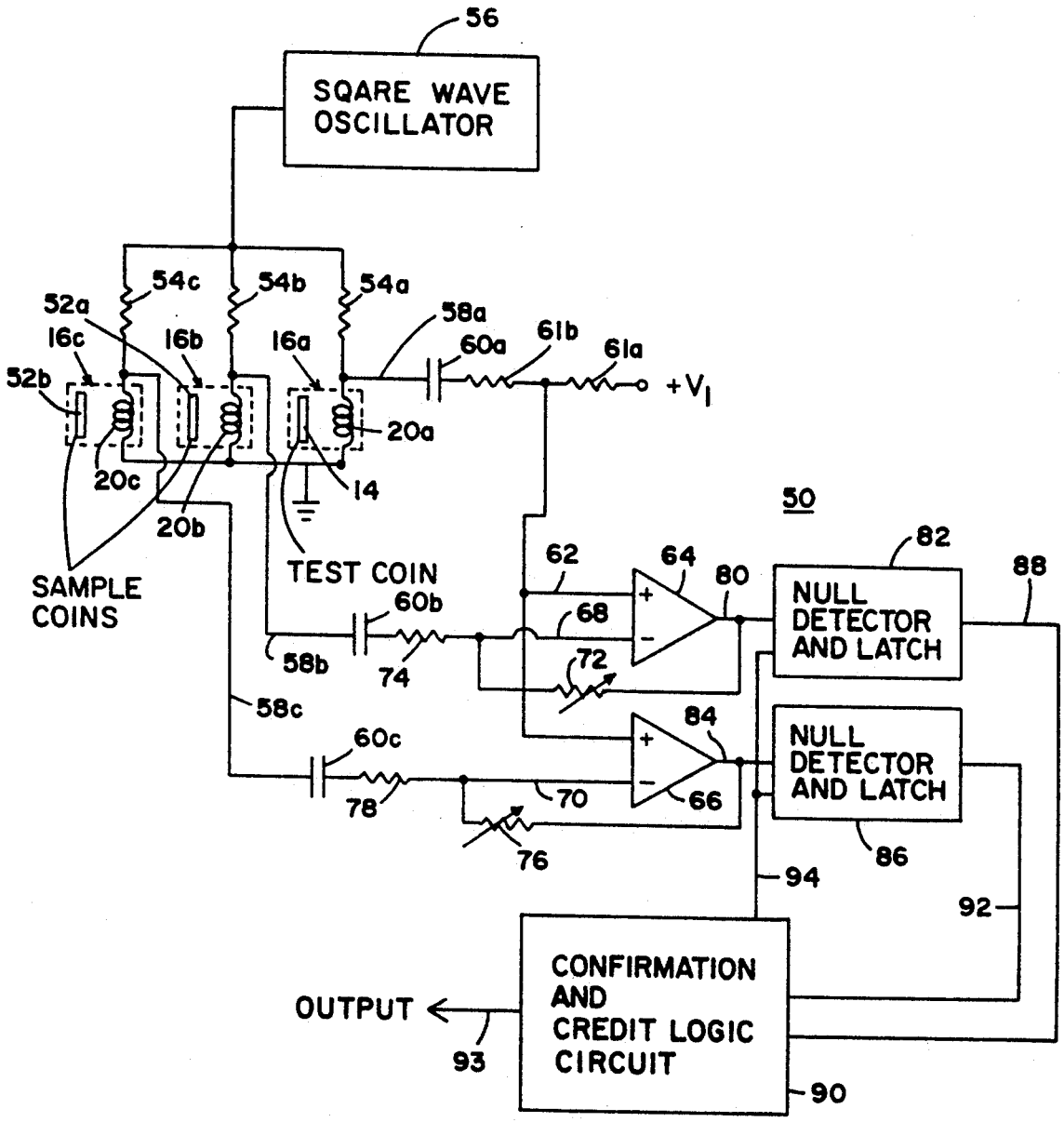
FIG. 5 is an electrical schematic diagram of a detection circuit according to the invention.

Detection circuit 22, used with sensor 16, may be either of the comparative detection circuit type, in which the effect of the test coin on the magnetic field produced by the sensor is compared with the effect of one or more test coins on similar fields generated by additional sensors 16, or may be of the non-comparative detection circuit type in which the effect of the test coin on the magnetic field, alone, determines the identity of the test coin. An example of a comparative detection circuit is illustrated in FIG. 5 in which detection circuit 50 includes a first test coin sensor 16*a* straddling the coin path 12, in the manner illustrated in FIGS. 1-4 and one or more sample coin sensors 16*b*, 16*c* . . . . Sample coin sensors 16*b*, 16*c* are similar to test coin sensor 16*a* except they are removed from the coin path 12 and include means (not shown) for positioning a sample coin 52*a* within the magnetic field generated by excitation means 20*b* associated with sensor 16*b* and for positioning a second test coin 52*b* in the magnetic field generated by excitation means 20*c* associated with sensor 16*c*. Excitation means, or coil, 20*a* is connected electrically in series with an impedance device, such as resistor 54*a*. Likewise, excitation coil 20*b* is electrically connected in series with a resistor 54*b* and excitation coil 20*c* is connected in electrical series with resistor 54*c*. These series combinations are, in turn, connected in parallel in a network that is supplied with a zero-DC-offset square wave signal produced by a square wave oscillator 56.

A junction 58*a* between coil 20*a* and resistor 54*a* is AC coupled through a capacitor 60*a* and a voltage divider consisting of resistors 61*a* and 61*b* with the non-inverting inputs 62 of a pair of differential amplifiers 64 and 66. Inputs 62 are DC coupled through resistor 61*a* to a DC reference voltage V. A junction 58*b* between coil 20*b* and resistor 54*b* is AC coupled by a capacitor 60*b* with an inverting input 68 of amplifier 64. A junction 58*c* between coil 20*c* and resistor 54*c* is AC coupled by a capacitor 60*c* with an inverting input 70 of amplifier 66. The gain of amplifier 64 is established by an adjustable feedback resistor 72 and a series bias resistor 74 extending to its inverting input 68. The gain of amplifier 66 is established by an adjustable feedback resistor 76 and a series bias resistor 78 connected with inverting input 70. A DC bias voltage $V_1$ is applied to non-inverting inputs 62 of amplifier 64 and 66 for reasons that will be set forth in more detail below.

An output 80 of amplifier 64 is provided as an input to a null detector and latch circuit 82. An output 84 of amplifier 66 is provided as an input to another null detector and latch circuit 86. Output 80 achieves a null condition when test coin 14 matches sample coin 52*a* positioned in sensor 16*b*. Otherwise, output 80 is at a high state. Likewise, output 84 achieves a null condition when test coin 14 matches the identity of sample coin 52*b* in sensor 16*c*. Otherwise, output 84 is in a high state. Null detector and latch 82 has an output 88 that is provided as an input to a confirmation and credit logic circuit 90 to indicate when a sufficiently deep null exist on output 80. Null detector and latch 86 produces an output 92 that is provided as an input to confirmation and credit logic circuit 90 to indicate that a sufficiently deep null has occurred on output 84. Confirmation and credit logic circuit 90 produces a reset signal on a line 94 in order to reset null detector and latches 82, 86 to non-latched states and an output signal on a line 93 in order to actuate an acceptance solenoid (not shown) and to indicate the amount of the coins/tokens that have been accepted.

Figure 6:
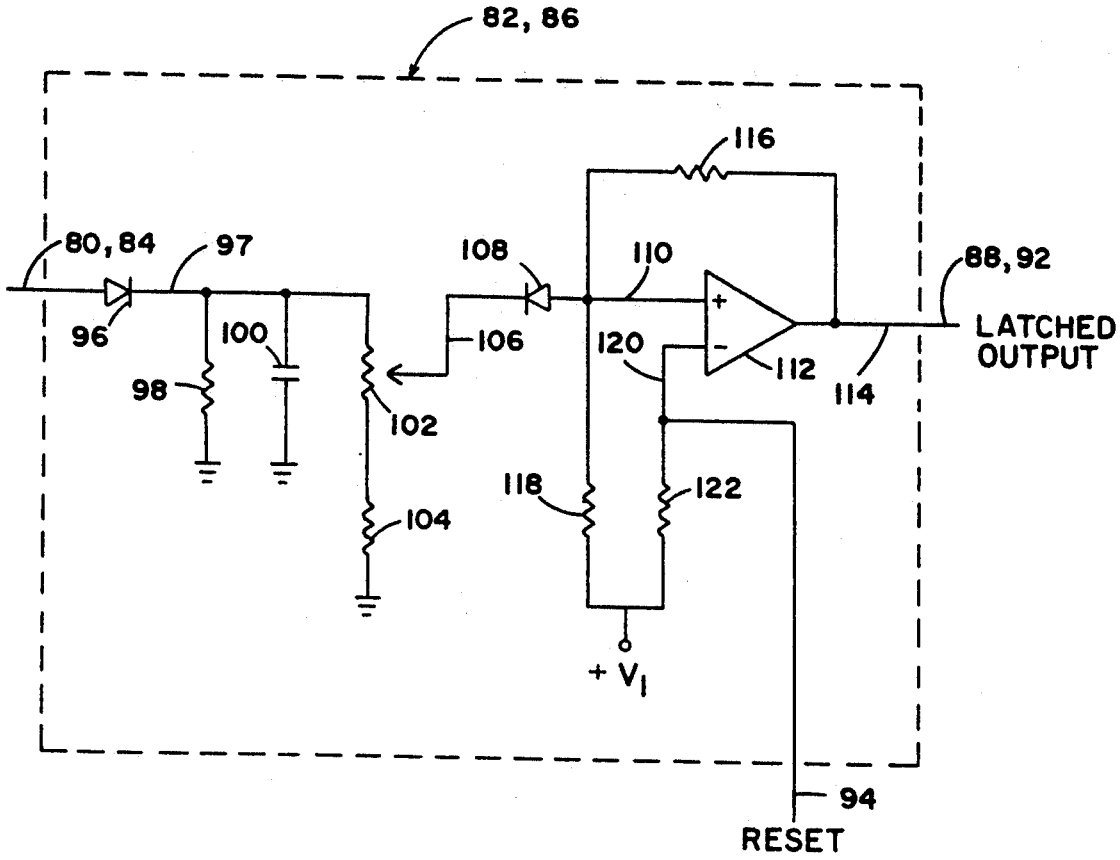
FIG. 6 is an electrical schematic diagram illustrating a portion of the detection circuit in FIG. 5 in more detail.

The details of null detector and latch circuits 82 and 86 are illustrated in FIG. 6. Each null detector and latch circuit 82, 86 receives an input from the respective output 80, 84 which is connected with a line 97 by a forwardly poled diode 96. A resistor 98 and capacitor 100 are connected between line 97 and signal ground. Line 97 is also connected to signal ground through a potentiometer 102 and a biasing resistor 104. A wiper 106 of potentiometer 102 is connected to the cathode of a diode 108, whose anode is connected with a non-inverting input 110 of a differential input amplifier 112. An output 114 of amplifier 112 is connected with input 110 by a latching resisting 116. Input 110 is connected with voltage source $V_1$ by a resistor 118. An inverting input 120 of amplifier 112 is also connected with voltage source $V_1$ by a resistor 122. The output 114 of amplifier 112 is provided as the output 88, 92 of the respective null detector and latch circuit 82, 86. The reset line 94 from confirmation and credit logic circuit 90 is connected with the inverting input 120 of amplifier 112.

Detection circuit 50 operates as follows. The positive bias voltage $V_1$ applied to non-inverting inputs 62 of amplifier 64 and 66 will appear as a DC offset equal to $V_1$ at the outputs 80 and 84 of the amplifiers. Accordingly, its output 80 is, likewise, an AC signal offset by bias voltage $V_1$. The signals at junctions 58*a* and 58*b* are AC signals which are AC coupled through capacitors 60*a* and 60*b* to amplifier 64. When a test coin 14 is juxtaposed with coil 20*a* of sensor 16, the attenuation of the magnetic field in sensor 16 will cause the signal level at inputs 62 to decrease. If test coin 14 matches sample coin 52*a*, the signal at input 68 will be equal to that at input 62 which will cause an AC null condition at output 80. This is accomplished by selecting the values of resistors 61*a*, 61*b*, 72 and 74 in order to provide the same impedance load to both coils 20*a* and 20*b*. By making feedback resistor 74 variable, a balance condition of inputs 62 and 68 may be adjustably calibrated. This may compensate for variations not only between coils 20*a* and 20*b* but also in coupling capacitors 60*a*, 60*b* and resistors 54*a* and 54*b*.

Output 80 is rectified and filtered by diode 96, resistor 98 and capacitor 100. Potentiometer 102 is a sensitivity adjustment to determine the depth of null required to indicate a coin match. If the null is sufficient to cause non-inverting input 110 of amplifier 112 to decrease below a scaler of $V_1$, then output 114 will go low. Resistor 116 will then force input 110 to a low condition which will latch output 114 in a low state even after the null-condition has terminated. Output 114 is unlatched in response to a reset pulse on line 94 from confirmation and credit logic circuit 90. Such reset pulse is typically in response to a confirmation sensor (not shown) sensing that the coin has, indeed, been deposited in a suitable coin receptacle in the coin analyzer system. A similar null-condition response is provided by amplifier 66, which is adjustably calibrated by resistor 76, in response to a match between test coin 14 and sample coin 52*b*. A latched output 92 from null detector and latch circuit 86, results.

Figure 7:
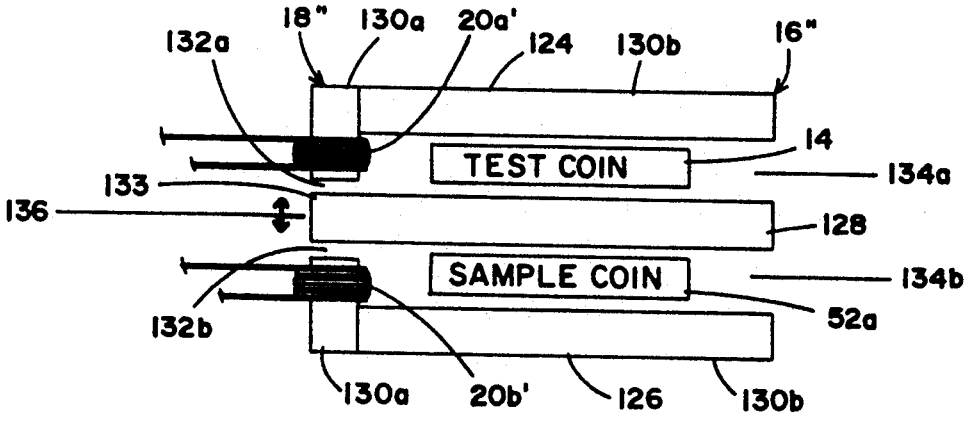
FIG. 7 is the same view as FIG. 2 of an alternative embodiment of a sensor according to the invention.
Figure 9:
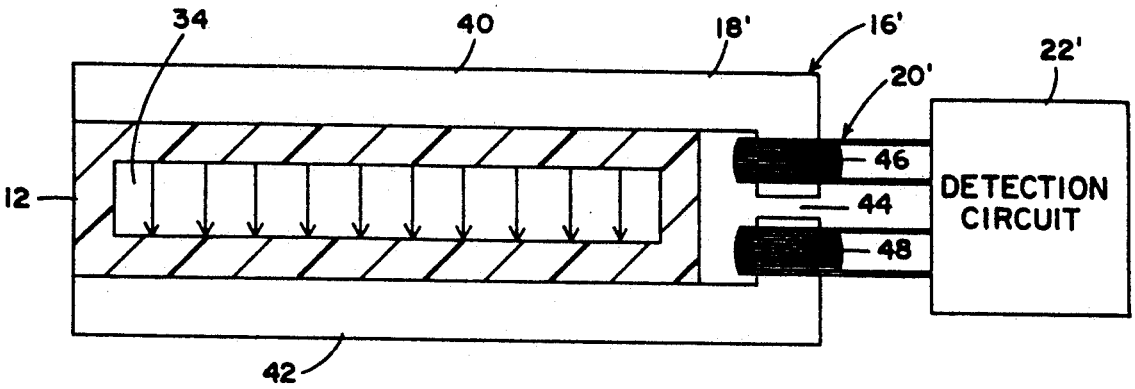
FIG. 9 is the same view as FIG. 2 of another alternative embodiment of a sensor according to the invention.

When it is desired to compare test coin 14 with only one sample coin, a sensor 16″ may be used with detection circuit 50 (FIG. 7). Of course, only a single amplifier 64 and a corresponding null detector and latch 82 will be required. Sensor 16″ includes a body 18″ having substantially identical first and second portions 124, 126 and a central third portion 128. Each of the first and second portions 124, 126 includes a base 130*a* and an elongated finger 130*b* extending outwardly from the base. As an alternative, portions 124, 126 may each be integrally formed in the same manner as portions 40, 42 (FIG. 9). Central portion 128 is positioned with an end 133 between bases 130*a* in a manner that provides adjustable air gaps 132*a*, 132*b* between the bases 130*a* and end 133 of central portion 128. A first coil 20*a*′ is wound around one base 130*a* and a second coil 20*b*′ is wound around the other base 130*b*. An air gap 134*a* is defined between finger 130*b* of first portion 124 and an air gap 134*b* is defined between finger 130*b* of second portion 126 and central portion 128. Means (not shown) are provided for positioning a sample coin 52 in air gap 134*b* and for passing a test coin 14 through air gap 134*a*. Adjustment means 136 is provided for adjustably positioning end 133 with respect to bases 130*a* to thereby, mechanically, adjust the magnetic circuits defined by sensor 16″ by adjusting the relative distance of air gaps 32*a* and 32*b*. When it is desired to compare a test coin 14 with only one sample coin 52*a*, sensor 16″ has the advantage of providing mechanical calibration of the balance of the circuit and, thereby, avoiding the necessity of a more detailed calibration of amplifier 64. The operation of sensor 16″ with detection circuit 50 is identical with that of the arrangement illustrated in FIGS. 5 and 6, except that only one amplifier 64, 66 and corresponding null detector and latch 82, 86 are utilized.

Figure 8:
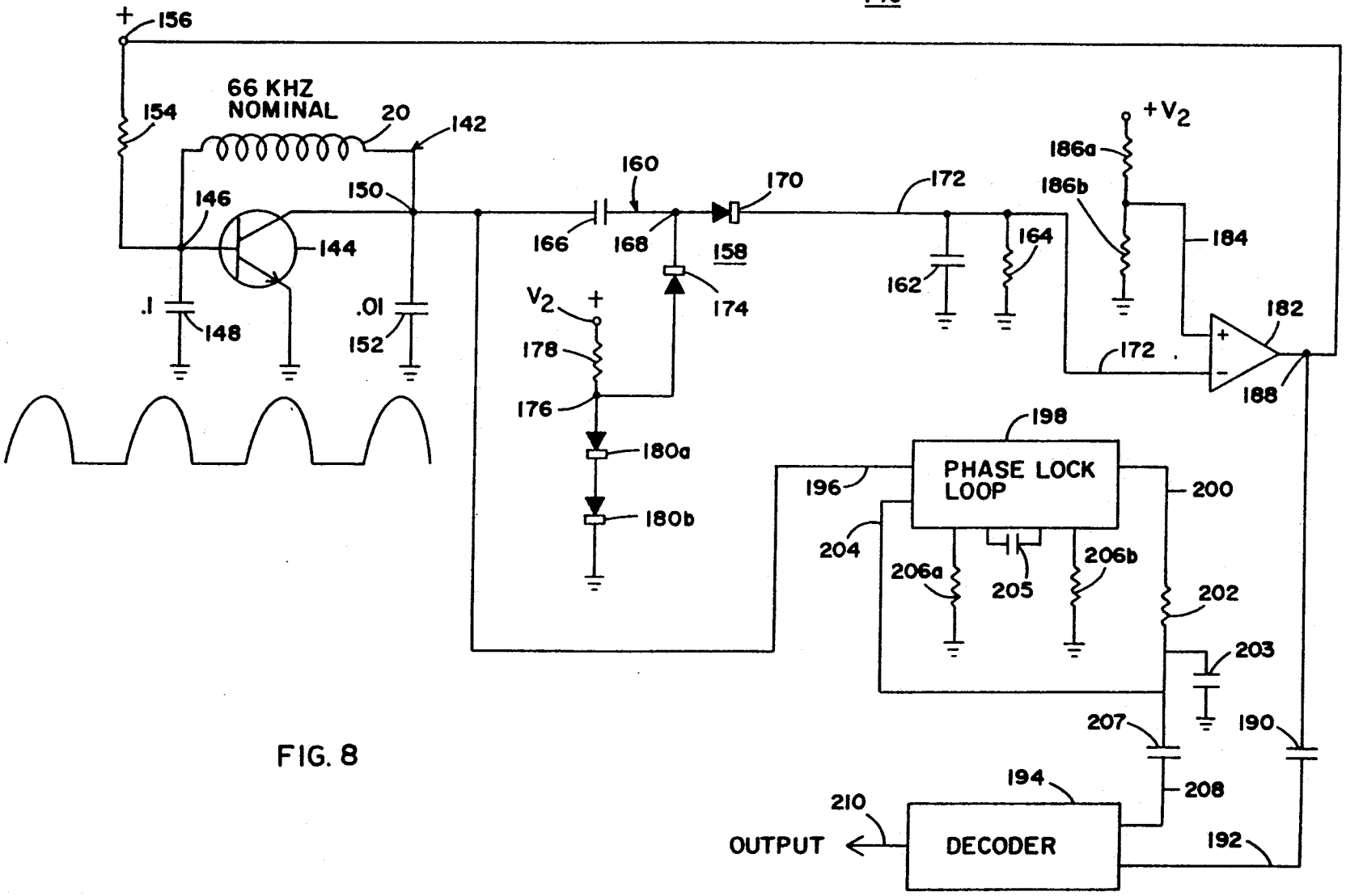
FIG. 8 is an electrical schematic diagram of a first alternative embodiment of a detection circuit according to the invention.

A non-comparative detection circuit 140 is useful with sensor 16 for the purpose of identifying whether a test coin is of a particular denomination of one or more particular coins, without requiring the use of sample coins (FIG. 8). Because sample coins are not required, detection circuit 140 has the advantage of eliminating the necessity of mechanical sample coin holders. In addition, a theoretically larger number of coin "matches" may be provided and, thereby, a test coin may be identified as one of a larger number of possible coin denominations. Detection circuit 140 includes an oscillator 142 including a switching transistor 144 having its base-collector junction in parallel with excitation coil 20. The base of transistor 144 is connected at junction 146 with one terminal of coil 20 and with one terminal of a capacitor 148, whose other terminal is connected with ground. The collector transistor 144 is connected at junction 150 with the other terminal of coil 20 and with one terminal of a capacitor 152 whose other terminal is connected with ground. Capacitor 148 has a capacitance value that is ten times that of capacitor 152. Junction 146 is provided with a DC bias voltage through a resistor 154 connected with a DC junction 156. With a DC voltage applied to junction 156, oscillator 142 oscillates at a nominal frequency, which in the illustrated embodiment is 66 kilohertz.

Junction 150, which represents the output of oscillator 142, is connected to a peak detecting circuit 158 which includes a rectifier circuit 160, a filter capacitor 162 and a load resistor 164. Rectifier circuit 160 includes a capacitor 166 connected between junction 150 and a junction 168 and a diode 170 connected between junction 168 and a junction 172. A filter is defined by a capacitor 162 and resistor 164 connected between junction 172 and signal ground. Rectifier circuit 160 additionally includes a diode 174 having its cathode connected with junction 168 and its anode connected with a junction 176 formed between a resistor 178, that is connected at its opposite end to a reference voltage $V_2$, and a with an anode terminal of a pair of series connected diodes 180*a*, 180*b*. Junction 172 is connected with the inverting input of a differential amplifier 182 whose non-inverting input 184 is connected with a reference voltage defined by a pair of resistors 186a, 186b connected in series between reference voltage $V_2$ and ground. The output 188 of amplifier 182 is connected with DC junction 156 to form a feedback loop. Output 188 is AC coupled by a capacitor 190 with an input 192 of a decoder circuit 194.

Junction 150 is also connected with an input 196 of a phase-lock-loop circuit 198. Phase-lock-loop circuit 198 includes an output 200 which is fed through a resistor 202, having a filter capacitor 203 to a feedback input 204. A pair of resistors 206a, 206b provide range limiters to establish the upper and lower frequency ranges of phase-lock-loop circuit 198. Output 200 is AC coupled by a capacitor 207 with an input 208 of decoder circuit 194. Decoder circuit 194 has an output 210 to indicate, such as by a digital word or the like, the identity, if any, of a particular denomination of a test coin 14 that is positioned in coin path 12 adjacent coil 20 as will be described below.

The arrangement of transistor 144 and capacitors 148 and 152 provide a virtual center-tap on coil 20. In the illustrated embodiment, capacitor 148 has a capacitance of 0.1 microfarads and capacitor 152 has a capacitance of 0.01 microfarads, which are in a suitable ratio to provide sufficient energy to ensure circuit oscillation. When a test coin 14 enters the coin path 12, it affects the inductance and the efficiency of coil 20 and, thereby, modifies the amplitude, the frequency, or both, of the output at junction 150. The output, which appears as the wave form illustrated in FIG. 8, is converted to a DC analog signal representative of the peak output voltage. This amplitude signal is supplied on line 172 and is compared with a fixed reference supplied on line 184 by amplifier 182. If the amplitude signal on line 172 is less than the fixed reference, in response to the insertion of a test coin into the coin path, output 188 of amplifier 182 increases the signal to DC junction 156 in order to restore the amplitude at output 150 to its nominal value. As the coin traverses the coin path, the resulting load on the magnetic field causes a momentary dip in the voltage at line 172. The resulting increase in the output level of amplifier 182 is thus has an AC component, which is coupled to decoder 194 through capacitor 190. This AC signal provides one piece of information about the test coin. Output 150 may additionally experience an increase in frequency as a test coin traverses the coin path. This is particularly true of coins made from highly conducting materials, which tend primarily to increase the frequency of oscillator 142. It should be noted that poorly conducting materials tend to affect both the amplitude and frequency of output 150. Input 196 of phase-lock-loop circuit 198 monitors the frequency of output 150 of oscillator 142. Output 200 of the phase-lock-loop circuit produces a feedback signal that is supplied to input 204 in order to lock the frequency of an internal voltage-controlled-oscillator, defined by resistors 206a, 206b and a capacitor 205, with the frequency at input 196. The change in this restoring signal on output 200 is proportional to the amount of change of the frequency of oscillator 142, resulting from the insertion of a test coin past coil 20. This varying component is coupled by capacitor 207 to input 208 of decoder 194. Resistors 206a and 206b establish, with capacitor 205, the locking range of the phase-lock-loop. This locking range extends from the quiescent frequency of oscillator 142 to the maximum deviation, with margins at both ends for temperature drift. These resistors are selected such that a highly conductive material will reach the upper end of the frequency band. Phase-lock-loop 198 is a CMOS 4046 circuit that is available from several manufacturers.

Thus it is seen that decoder 194 receives the AC components of output 200 of phase-lock-loop circuit 198 and output 188 of amplifier 182. Both of these signals are feedback signals having a significant amplitude with respect to the signal being monitored. Accordingly, the input signals to decoder 194 are robust and, accordingly, capable of providing distinguishing characteristics of the coin being inserted in the coin path 12. Decoder 194 has stored therein the frequency shift and amplitude shift characteristics of a number of coin denominations, with which a test coin is to be compared, to identify the denominations of the test coin. There are many ways in which decoder 194 could be implemented, as would be well understood by the skilled artisan. For example, a digital implementation, with a microprocessor, may include a lookup table of the frequency shift and the amplitude shift characteristics of the desired coin denominations. An input sample-and-hold circuit would momentarily retain the peak value of the input signals on lines 208 and 192 in order to provide the necessary comparison with the lookup table. Alternatively, for a relatively small number of coin denominations, decoder 194 could be implemented with an analog circuit. In order to provide a comparison with two coin denominations, such analog circuit would include a sample-and-hold input and four analog switches coupled with the output of the sample-and-hold circuit and with two sets of comparators in order to compare the input signals on lines 208 and 192 with a variety of reference voltage levels representing the frequency shift and amplitude shift characteristics of the possible coin denominations. Other implementations will suggest themselves to those skilled in the art.

An important characteristic of the non-comparison detection circuit 140 is that the necessity for sample coins and sample coin holders is eliminated. However, there is a necessity for overcoming the tendencies for voltage drift and component aging drift, which could introduce inaccuracies in such a system. Detection circuit 140 significantly overcomes these tendencies by utilizing a peak detecting circuit 158 having offsetting temperature-dependant characteristics. Diodes 170 is connected with diodes 174, 176 and 178 in a manner that any change in the forward voltage drop resulting from temperature variations will be cancelled out by the offsetting effect between diodes 170 and 174 and diodes 180a and 180b. Otherwise, peak detector circuit 158 operates in a conventional manner. Positive going swings in the output of oscillator 142 cause diode 170 to be forward biased so that capacitors 166 and 162 charge to a level that is determined by the peak amplitude of output 150, while diode 174 is reversed bias. As the voltage swing in output 150 goes negative, diode 170 becomes reverse biased and diode 174 becomes conducting allowing capacitor 166 to discharge without discharging capacitor 162. Because the anode of diode 174 is clamped by diodes 180a and 180b, the voltage at junction 168 will be one diode junction drop above ground, which will equal a zero-voltage offset on line 172, when diode 170 becomes conducting. When the output again goes positive, capacitors 166 and 162 charge to the level of the output 150. In addition to providing a balanced voltage drop across the diodes in a manner that will cancel out temperature variations, the supply of voltage $V_2$ to both the peak detection circuit and the reference input 194 of amplifier 182, causes detection circuit 140 to be less susceptible to supply voltage variations resulting from temperature changes and the like. Furthermore, the AC coupling of the outputs 188 and 200 to inputs 192 and 208 of decoder 194, eliminated temperature drift-induced DC offsets on the outputs of amplifier 182 and phase-lock-loop circuit 198.

An alternative embodiment of a sensor 16' includes a pair of core portions 40, 42 that are formed in an L-shape and separated by a second air gap 44 (FIG. 9). This second air gap is provided in order to cause the change in circuit flux resulting from a coin passing through primary air gap 34 to affect the transmission between coils 46 and 48. In the illustrated embodiment, air gap 44 is of a separation distance that is predetermined to provide the same magnetic reluctance across air gap 44 as that across the primary air gap 34. This magnetic impedance-matching, or reluctance-matching, requires a smaller separation distance in air gap 44 because the surface area of the interface is substantially less than that of primary air gap 34, as is understood by the skilled artisan. The separation distance of air gap 44 is preferably made adjustable by suitable adjustment means (not shown) to provide adjustment capability for the overall circuit reluctance of body 18'.

Because core portions 40, 42 are individually formed, excitation means 20' may include a first coil 46 magnetically coupled with core portion 40 and a second coil 48 magnetically coupled with core portion 42. In contrast to sensor 16, in which excitation means 20 both establishes field 32 and monitors attenuation of the field as a result of passage of a test coin 14, one coil 46, 48 of sensor 16' may be used as an excitation coil, or transmitting coil, with the other coil 46, 48 being a receiving coil. Coils 46, 48 of sensor 16' are connected with a detection circuit 22'. Because the high permeability magnetic material forming bodies 18 and 18' may be molded in a manner similar to a plastic article, core portions 40, 42 may each be integrally formed In contrast, body 18' is illustrated as being formed from plane bars of magnetic material cut to length and adhesively joined.

Sensor 16' (FIG. 9), having separate transmitting and sensing coils 46, 48 may utilize a detection circuit of the type disclosed in U.S. Pat. No. 4,884,672 issued to the present inventor for a COIN ANALYZER SYSTEM AND APPARATUS, the disclosure which is hereby incorporated herein by reference, utilizing a plurality of sensor units 16' in order to compare a tested coin with at least two different sample coins. For such comparison with two sample coins, three sensor units 16' are provided, one surrounding coin path 12 and two that do not. The two that do not surround the coin path, each have a sample coin positioned in the air gap. One coil 46, 48 of each sensor unit is connected with each other in series with a signal source to generate a magnetic field in each air gap. The other coil 46, 48 of each sensor 16' are connected with each other in a Y configuration with one terminal of the same plurality of each sensing coil interconnected. Opposite terminals of the sensing coils of the sample coin sensor units are connected each with the inverting input of one of a pair of comparators. The opposite terminal of the sensing coil of the test coil sensor is connected with the inverting input of the comparators. The outputs of the comparators are tested for sufficient null condition to indicate a match between a tested coin and the corresponding one of the sample coins. The operation of such detection circuit is set forth in detail in the '672 patent and will not be repeated herein.

Figure 10:
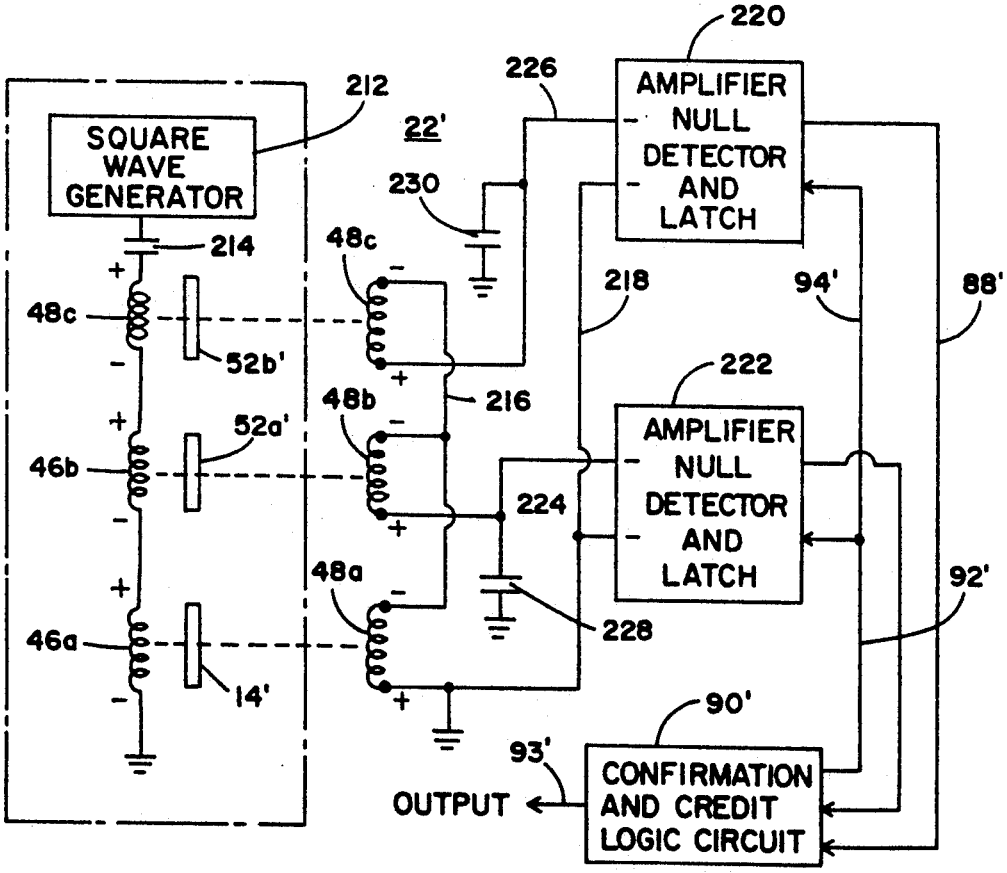
FIG. 10 is an electrical schematic diagram of a second alternative embodiment of a detection circuit according to the invention.

A detection circuit 22' may include a square wave generate 212, a DC blocking capacitor 214 and a series connection of coils **46*a*, of a test coin sensor 16', and coils 46*b* and 46*c* of two sample coin sensors 16' (FIG. 10). Coils 48*a* of the test coin sensor and 48*b* and 48*c* of sample coin sensors, are connected with one terminal of like polarity of each coil connected together at junction 216. Output 218 of coil 48*a* is provided to the inverting input of amplifier, null detector and latch circuits 220 and 222. Terminal 224 of coil 48*b* is connected with the non-inverting input of circuit 222 and terminal 226 of coil 48*c* is connected with the non-inverting input of circuit 220. Output 88' of circuit 220 and output 94' of circuit 222 are provided as inputs to confirmation and credit logic circuit 90'. Circuit 90', in turn provides a reset pulse on line 94' to reset amplifier, null detector and latch circuits 220 and 222 upon the confirmation that a coin has been deposited in a coin receptacle (not shown). In order to reduce the susceptibility of detection circuit 22' to radio frequency (RF) interference, a capacitor 228 may be provided shunting line 224 to ground and a capacitor 230 may be provided shunting line 226** to ground.

Transmitting coils **46*a*, 46*b* and 46*c* combine with the reactance of capacitor 214 to provide a natural resonant frequency of circuit 22'. In addition, the presence of filter capacitors 228 and 230 provide a natural resonant frequency of coils 48*a*, 48*b* and 48*c***. The result has been that the transmitting coil circuit tends to resonate at a relatively low frequency, while the filter capacitors on the receiving coils tend to cause resonance at a relatively high frequency. In order to increase the frequency content provided to the sensing coils, prior art coin recognition circuits have differentiated the output of a square wave generator by providing a low capacitance value capacitor between the output of the square wave generator and the transmitting coils. Such technique is disclosed in U.S. Pat. No. 4,469,213 issued to Raymond Nicholson and the present inventor for a COIN DETECTOR SYSTEM.

It has been discovered that such prior art coin detector system, such as that disclosed in the '213 patent, suffers from a tendency for the natural resonant frequency of the coils to be located at a low order harmonic of the fundamental frequency of the square wave generator. The result has been that the differentiated, or spiked, output of the square wave generator, in the prior art, causes a ringing in the transmitting coils which produces large output spikes on the receiving coils. In order to avoid saturation of the detecting amplifiers, the gain of the amplifiers is reduced. This reduction in gain, in combination with the large amplitude of the resonance pulses, has been discovered to produce a rather unsatisfactory narrow-band response of the prior art systems. This is in contrast to the professed object of the prior art to produce a multitude of frequencies for providing better detection signals capable of finer discrimination.

In order to overcome the problems of the prior art, the use of a low-capacitance value spiking capacitor on the output of square wave generator 212 is eliminated. Although a capacitor 214 is provided between square wave generator 212 and the series connection of coils 46a–46c, the function of capacitor 214 is strictly as a DC blocking capacitor. Thus if square wave generator 212 had zero DC offset, capacitor 214 could be eliminated altogether. Because the capacitance of capacitor 214 is very large, the natural resonant frequency of the transmitting coils 46a–46c is virtually eliminated. Additionally, by lowering the frequency of square wave generator 212, the natural resonant frequency produced by capacitors 228 and 230 no longer coincides with a low-order harmonic of the fundamental frequency of square wave generator 212. The net result is that the transmitting and receiving coils of detection circuit 22' are supplied with a square wave signal of zero DC offset with little or no reactive response. The result is a rich mixture of frequency components with no particular frequency band tending to dominate the others. The amplification of amplifier, null detector and latch circuits 220 and 222 may be increased to provide further sensitivity in the detection of null conditions. In the illustrated embodiments, capacitor 214 is a 10 microfarads tantalum capacitor. This is in contrast to the 0.1 microfarad film capacitor used to differentiate, or spike, the square wave signal in the prior art. The primary frequency of square wave generator 212 may be reduced to 3.2 kilohertz although operation up to and including 10 kilohertz has been found to be satisfactory. Although a 3.2 kilohertz operation of square wave generator 212 produces some dip in the amplitude of the square wave, such dip is too insignificant to affect the output signal.

Accordingly, it is seen that the present invention provides significant improvement in all aspects of a coin analyzer system. A unique sensor is provided that produces an exceptionally uniform field of high flux density in order to allow a coin to be detected irrespective of speed or position in the coin path. In fact, the present invention allows a free-fall coin detecting capability. Furthermore, the incorporation of a flux return path in the sensor eliminates the difficulties of interference with the stray magnetic fields produced by known sensors. A sensor according to the invention is capable of taking various forms, which provide additional useful benefits such as the ability to provide mechanical tuning of the electronic circuit as well as to provide various coil configurations. The latter allows a sensor, according to the invention, to be interfaced with a various number of detection circuits.

The present invention further provides detection circuits of both the comparison and non-comparison type, all having superior operating characteristics. In a non-comparison circuit according to the invention, feedback signals adapted to restoring a quiescent condition of an oscillator circuit that is coupled with a test coin, are monitored in order to produce detection signals. Because of their relative strength, such feedback signals provide exceptional resolution of the characteristics of the coins being tested. In addition, specific techniques provided to offset temperature drift and component aging characteristics are provided. In a comparison circuit according to the invention, a unique null detector and latch circuit eliminates many of the components of prior art systems as well as provides exceptional temperature and age stability. Furthermore, a unique excitation arrangement that is particularly adaptable to the comparison type detection circuits, provides superior detection signals by eliminating resonance-induced voltage spikes in the excitation signals by avoiding natural resonant frequencies at low-order harmonics of the primary frequency of the excitation signal, which is advantageously a zero DC offset square wave.

Changes and modifications in the specifically described embodiments can be carried out without departing from the principles of the invention, which is intended to be limited by the scope of the appended claims, as interpreted according to the principles of patent law including the doctrine of equivalents.

The embodiments of the invention in which an exclusive property of privilege is claimed are defined as follows:

1. A coin detecting sensor comprising a body having spaced apart sides defining an air gap in said body, said air gap being configured to position a coin in said air gap, means for generating a magnetic flux from one of said sides to the other one of said sides through said air gap and a return path in said body for conducting said magnetic flux to said one of said sides from said another one of said sides wherein said body terminates in facing surfaces defining said air gap, and wherein said facing surfaces converge outwardly from a central portion of said body to provide a uniform magnetic circuit reluctance at all portions of said air gap.

2. The sensor in claim 1 wherein said body is made from a ferro-magnetic material.

3. The sensor in claim 2 wherein said ferro-magnetic material has high permeability.

4. The sensor in claim 3 wherein said permeability is at least approximately 2000.

5. A coin detecting sensor comprising:

a generally C-shaped core of ferro-magnetic material including a bight portion and a pair of spaced apart arms extending in a same direction from said bight portion, defining a coin sensing region between said arms;

a coin chute passing through said coin sensing region; and at least one coil magnetically coupled with said core in order to generate a magnetic flux in said core and produce a uniform flux density between said arms in said air gap extending across said coin chute substantially completely when said coil is excited with electrical energy to thereby allow a coin to be detected irrespective of the position or velocity of the coin in the coin chute.

6. The sensor in claim 5 wherein said at least one coil is wound around said bight portion.

7. The sensor in claim 5 wherein said arms define facing surfaces and wherein said facing surfaces include a multiplicity of facing surface portions that are separated by distances predetermined to provide a uniform magnetic circuit reluctance through all said facing surface portions.

8. The sensor in claim 5 wherein said ferro-magnetic material has high permeability.

9. The sensor in claim 8 wherein said permeability is at least approximately 2000.

10. A coin detecting sensor comprising:

a generally C-shaped core of ferro-magnetic material including a bight portion and a pair of spaced apart arms extending in a same direction from said bight portion, defining a coin sensing region between said arms, wherein said core is divided into two core portions divided by a secondary air gap; and at least one coil magnetically coupled with said core in order to generate a magnetic flux in said core and across said coin sensing region and said secondary air gap when said coil is excited with electrical energy.

11. The sensor in claim 10 wherein said secondary air gap is adjustable in order to enable the circuit reluctance of said core to be adjustable.

12. The sensor in claim 10 wherein said ferro-magnetic material has a high permeability.

13. The sensor in claim 12 wherein said permeability is at least approximately 2000.

14. A coin detecting sensor comprising:

a generally C-shaped core of ferro-magnetic material including a bight portion and a pair of spaced apart arms extending in a same direction from said bight portion, defining a coin sensing region between said arms, wherein said arms define facing surfaces and wherein said facing surfaces converge outwardly from said bight portion to define a multiplicity of facing surface portions that are separated by distances predetermined to provide a uniform magnetic circuit reluctance through all said facing surface portions; and at least one coil magnetically coupled with said core in order to generate a magnetic flux in said core and across said coin sensing region when said coil is excited with electrical energy.

15. The sensor in claim 13 wherein said ferro-magnetic material has high permeability.

16. The sensor in claim 15 wherein said permeability is at least approximately 2000.

17. A coin detecting system adapted to detecting whether a coin passing through a coin passageway is a particular one of a plurality of denominations comprising:

a sensor unit including a body having spaced apart sides defining an air gap in said body, a coin passageway having a width larger than the diameter of the largest coin of the particular denominations to be detected defined in said air gap, means for generating a magnetic flux from one of said sides to the other of said sides through said air gap and a return path in said body for said magnetic flux to said one of said sides from said other one of said sides wherein a uniform flux density extends across said width of said coin passageway substantially completely to thereby allow the identify of any coin of the particular denominations to be detected irrespective of the position of the coin in the coin passageway; and a detection circuit responsive to said magnetic flux when a coin is in said air gap and adapted to determining if said coin is of a particular type of coin.

18. The sensor in claim 17 wherein said body is made from a ferro-magnetic material.

19. The sensor in claim 18 wherein said ferro-magnetic material has a high permeability.

20. The sensor in claim 19 wherein said permeability is at least approximately 2000.

21. A coin detecting system comprising:

a sensor unit including a body having spaced apart sides defining an air gap in said body said air gap being configured to position a coin in said air gap, means for generating a magnetic flux from one of said sides to the other of said sides through said air gap and a return path in said body for said magnetic flux to said one of said sides from said other one of said sides; and a detection circuit responsive to said magnetic flux when a coin is in said air gap and adapted to determining if said coin is of a particular type of coin, wherein said detection circuit includes an oscillator having an induction device magnetically coupled with said body such that a coin in said air gap disturbs said oscillator and feedback means for restoring said oscillator to a quiescent condition, said detection circuit further including means for monitoring said feedback means.

22. The system in claim 21 wherein said monitoring means monitors the amplitude and frequency of a signal produced by said feedback means.

23. The system in claim 21 wherein a coin passageway having a particular width is defined in said air gap and wherein said magnetic flux is uniform across said width of said coin passageway substantially completely to thereby allow a coin to be detected irrespective of the position of the coin in the coin passageway.

24. A coin detection system adapted to determine whether a coin passing through a coin chute is a particular one of a plurality of denominations comprising:

a coin sensor unit including an induction device and means for passing a test coin through a magnetic field produced by said induction device when said induction device is electrically excited;

an oscillator circuit including said induction device, said oscillator circuit adapted to oscillating at a quiescent condition with no coin in said magnetic field and thereby generating an output signal having a nominal frequency and a nominal amplitude;

a feedback circuit responsive to said output signal and adapted to producing a feedback signal that is applied to said oscillator circuit to return said output signal to said quiescent condition in response to a test coin passing through said magnetic field causing said output signal to deviate from said quiescent condition; and a detection circuit that is responsive to said feedback signal in order to determine that a test coin is of a particular denomination.

25. The system in claim 24 wherein said coin sensor includes a generally C-shaped core of ferro-magnetic material including a bight portion and a pair of spaced apart arms extending in a same direction from said bight portion defining a coin sensing region between said arms and wherein said induction device is magnetically coupled with said core to produce said magnetic field in said coin sensing region.

26. The system in claim 24 wherein said feedback circuit is responsive to an amplitude of said output signal to return said amplitude to a quiescent condition.

27. The system in claim 25 wherein a coin passageway having a particular width extends in said coin sensing region and wherein said magnetic field is uniform across said width of said coin passageway substantially completely to thereby allow a coin to be detected irrespective of the position of the coin in the coin passageway.

28. A coin detection system comprising:

a coin sensor unit including an induction device and means for positioning a test coin in a magnetic field produced by said induction device when said induction device is electrically excited;

an oscillator circuit including said induction device, said oscillator circuit adapted to oscillating at a quiescent condition with no coin in said magnetic field and thereby generating an output signal having a nominal frequency and a nominal amplitude;

a feedback circuit responsive to said output signal and adapted to producing a feedback signal that is applied to said oscillator circuit to return said output signal to said quiescent condition in response to a test coin causing said output signal to deviate from said quiescent condition; and a detection circuit that is responsive to said feedback signal in order to identify whether a test coin is of a particular type of coin, wherein said detection circuit responds to an amplitude and a frequency of said feedback signal.

29. A coin detecting sensor adapted to detect whether a coin passing through a coin passageway is a particular one of a plurality of denominations having a range of diameters, comprising a body having spaced apart sides defining an air gap in said body, a coin passageway having a width larger than the diameter of the largest coin of the particular denominations to be detected defined in said air gap, a magnetic flux generator for generating a magnetic flux from one of said sides to the other one of said sides through said air gap and a return path in said body for conducting said magnetic flux to said one of said sides from said another one of said sides, wherein a uniform flux density extends across said width of said coin passageway substantially completely to thereby allow any of said plurality of denominations to be detected irrespective of position of the coin in the coin passageway.

30. The sensor in claim 29 wherein said body is made from a ferro-magnetic material.

31. The sensor in claim 30 wherein said ferro-magnetic material has high permeability.

32. The sensor in claim 31 wherein said permeability is at least approximately 2000.

33. The sensor in claim 29 including a coin chute adapted to passing coins in free-fall through said air gap.

* * * * *

UNITED STATES PATENT AND TRADEMARK OFFICE

CERTIFICATE OF CORRECTION

PATENT NO. : 5,293,980
DATED : March 15, 1994
INVENTOR(S) : Donald O. Parker

It is certified that error appears in the above-indentified patent and that said Letters Patent is hereby corrected as shown below:

Column 11, line 42
After "formed" insert --.--;

Column 15, Claim 15, line 26
"claim 13" should be --claim 14--;

Column 15, Claim 17, line 45
"identify" should be --identity--.

Signed and Sealed this

Twenty-seventh Day of September, 1994

*Attest:*

Bruce Lehman

BRUCE LEHMAN

*Attesting Officer*

*Commissioner of Patents and Trademarks*